US011636794B2

(12) United States Patent
Chang et al.

(10) Patent No.: US 11,636,794 B2
(45) Date of Patent: Apr. 25, 2023

(54) PIXEL DRIVING DEVICE

(71) Applicant: AU Optronics Corporation, Hsin-Chu (TW)

(72) Inventors: Che-Chia Chang, Hsin-Chu (TW); Yi-Jung Chen, Hsin-Chu (TW); Shang-Jie Wu, Hsin-Chu (TW); Yu-Chieh Kuo, Hsin-Chu (TW); Hsien-Chun Wang, Hsin-Chu (TW); Ming-Hung Chuang, Hsin-Chu (TW); Mei-Yi Li, Hsin-Chu (TW); Chen-Ying Chou, Hsin-Chu (TW); Sin-An Lin, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 71 days.

(21) Appl. No.: 17/469,165

(22) Filed: Sep. 8, 2021

(65) Prior Publication Data

US 2022/0223086 A1 Jul. 14, 2022

(30) Foreign Application Priority Data

Jan. 12, 2021 (TW) ..... 110101117

(51) Int. Cl.
*G09G 3/20* (2006.01)

(52) U.S. Cl.
CPC ..... *G09G 3/20* (2013.01); *G09G 2370/08* (2013.01)

(58) Field of Classification Search
CPC ..... G09G 3/20; G09G 2370/08
See application file for complete search history.

(56) References Cited

U.S. PATENT DOCUMENTS

| | | | | |
|---|---|---|---|---|
| 2015/0293546 | A1 | 10/2015 | Tanaka et al. | |
| 2016/0370635 | A1 | 12/2016 | Tanaka et al. | |
| 2018/0011504 | A1 | 1/2018 | Tanaka et al. | |
| 2019/0302815 | A1 | 10/2019 | Tanaka et al. | |
| 2019/0325843 | A1* | 10/2019 | Pyun | G09G 3/20 |
| 2019/0348836 | A1* | 11/2019 | Wen | H02H 9/045 |
| 2020/0074932 | A1 | 3/2020 | Park et al. | |
| 2021/0103307 | A1 | 4/2021 | Tanaka et al. | |

FOREIGN PATENT DOCUMENTS

CN 104756177 A 7/2015

* cited by examiner

*Primary Examiner* — Sejoon Ahn
(74) *Attorney, Agent, or Firm* — WPAT, PC

(57) ABSTRACT

A pixel driving device includes at least one data line and at least one driver integrated circuit. The at least one data line includes a first area and a second area on both sides. The first area and the second area are separated by the at least one data line. The at least one driver integrated circuit includes a first circuit and a second circuit. The first circuit is disposed in the first area, is configured to receive at least one first high-frequency signal so as to at least one first driving signal. The second circuit is disposed in the second area, is coupled to the first circuit and is configured to receive at least one low-frequency signal.

10 Claims, 15 Drawing Sheets

PIXEL DRIVING DEVICE

CROSS-REFERENCE TO RELATED APPLICATION

This application claims priority to Taiwan Application Serial Number 110101117, filed on Jan. 12, 2021, which is herein incorporated by reference in its entirety.

BACKGROUND

Field of Invention

The present disclosure relates to an electronic device. More particularly, the present disclosure relates to a pixel driving device.

Description of Related Art

Gate driver integrated circuits (IC) on both sides of a panel can be designed in an active area (AA) of a panel. Based on this circuit layout, circuits and data lines are cross over to each other. Therefore, high-frequency signals from circuits are coupling to data lines so as to generate a display mura in a panel.

For the foregoing reason, there is a need to provide other suitable circuits to solve the problems of the prior art.

SUMMARY

One aspect of the present disclosure provides a pixel driving device. The pixel driving device includes at least one data line and at least one driver integrated circuit. The at least one data line includes a first area and a second area on both sides. The first area and the second area are separated by the at least one data line. The at least one driver integrated circuit includes a first circuit and a second circuit. The first circuit is disposed in the first area, and is configured to receive at least one first high-frequency signal so as to output at least one first driving signal. The second circuit is disposed in the second area, is coupled to the first circuit, and is configured to receive at least one low-frequency signal.

Another aspect of the present disclosure provides a pixel driving device. The pixel driving device includes at least one driver integrated circuit. The at least one driver integrated circuit includes a first circuit, a second circuit, and a third circuit. The first circuit is configured to receive a high-frequency signal and output a driving signal. The first circuit is disposed in a first area of the pixel driving device. The second circuit is coupled to the first circuit, and is configured to receive a low-frequency signal. The second circuit is disposed in a second area of pixel driving device. The third circuit is coupled to the second circuit, and configured to receive the high-frequency signal. The third circuit is disposed in a third area of the pixel driving device. The first area, the second area, and the third area are not overlapped with each other.

BRIEF DESCRIPTION OF THE DRAWINGS

The present disclosure can be more fully understood by reading the following detailed description of the embodiment, with reference made to the accompanying drawings as follows.

DETAILED DESCRIPTION

Figure 1:
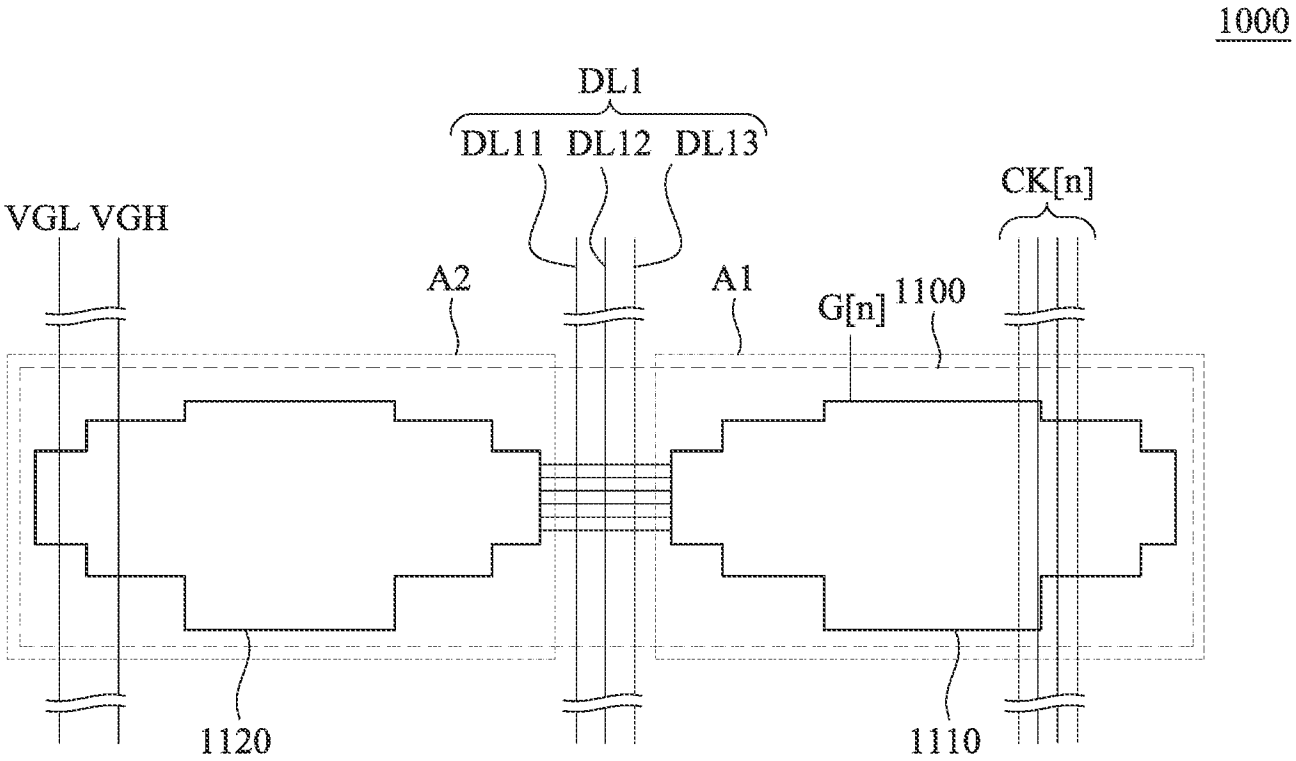
FIG. 1 depicts a schematic diagram of a pixel driving device according to some embodiments of the present disclosure.

Reference will now be made in detail to the present embodiments of the invention, examples of which are illustrated in the accompanying drawings. Wherever possible, the same reference numbers are used in the drawings and the description to refer to the same or like parts.

The terminology used herein is for the purpose of describing particular example embodiments only and is not intended to be limiting of the present disclosure. As used herein, the singular forms "a," "an" and "the" are intended to include the plural forms as well, unless the context clearly indicates otherwise.

Furthermore, it should be understood that the terms, "comprising", "including", "having", "containing", "involving" and the like, used herein are open-ended, that is, including but not limited to.

The terms used in this specification and claims, unless otherwise stated, generally have their ordinary meanings in the art, within the context of the disclosure, and in the specific context where each term is used. Certain terms that are used to describe the disclosure are discussed below, or elsewhere in the specification, to provide additional guidance to the practitioner skilled in the art regarding the description of the disclosure.

FIG. 1 depicts a schematic diagram of a pixel driving device 1000 according to some embodiments of the present disclosure. In some embodiments, as shown in FIG. 1, the pixel driving device 1000 includes at least one data line DL1 (e.g. one of data line DL11, data line DL12, and data line DL13) and at least one driver integrated circuit 1100. The at least one data line DL1 includes a first area A1 and a second area A2 on both sides. The first area A1 and the second area A2 are separated by the at least one data line DL1. The at least one driver integrated circuit 1100 includes a first circuit 1110 and a second circuit 1120. The first circuit 1110 is disposed in the first area A1, and is configured to receive at least one first high-frequency signal (e.g. a high-frequency signal CK[n] shown in the figure). The second circuit 1120 is disposed in the second area A2, is coupled to the first circuit 1110, and is configured to receive at least one low-frequency signal (e.g. a voltage level VGH and a voltage level VGL shown in the figure). The first circuit 1110 is configured to output at least one first driving signal G[n]. It is noted that although the first area A1 and the second area A2 are depicted as a left side and a right side in FIG. 1 respectively. In practice, the first area A1 and the second area A2 are not limited to the left side and the right side.

Figure 2:
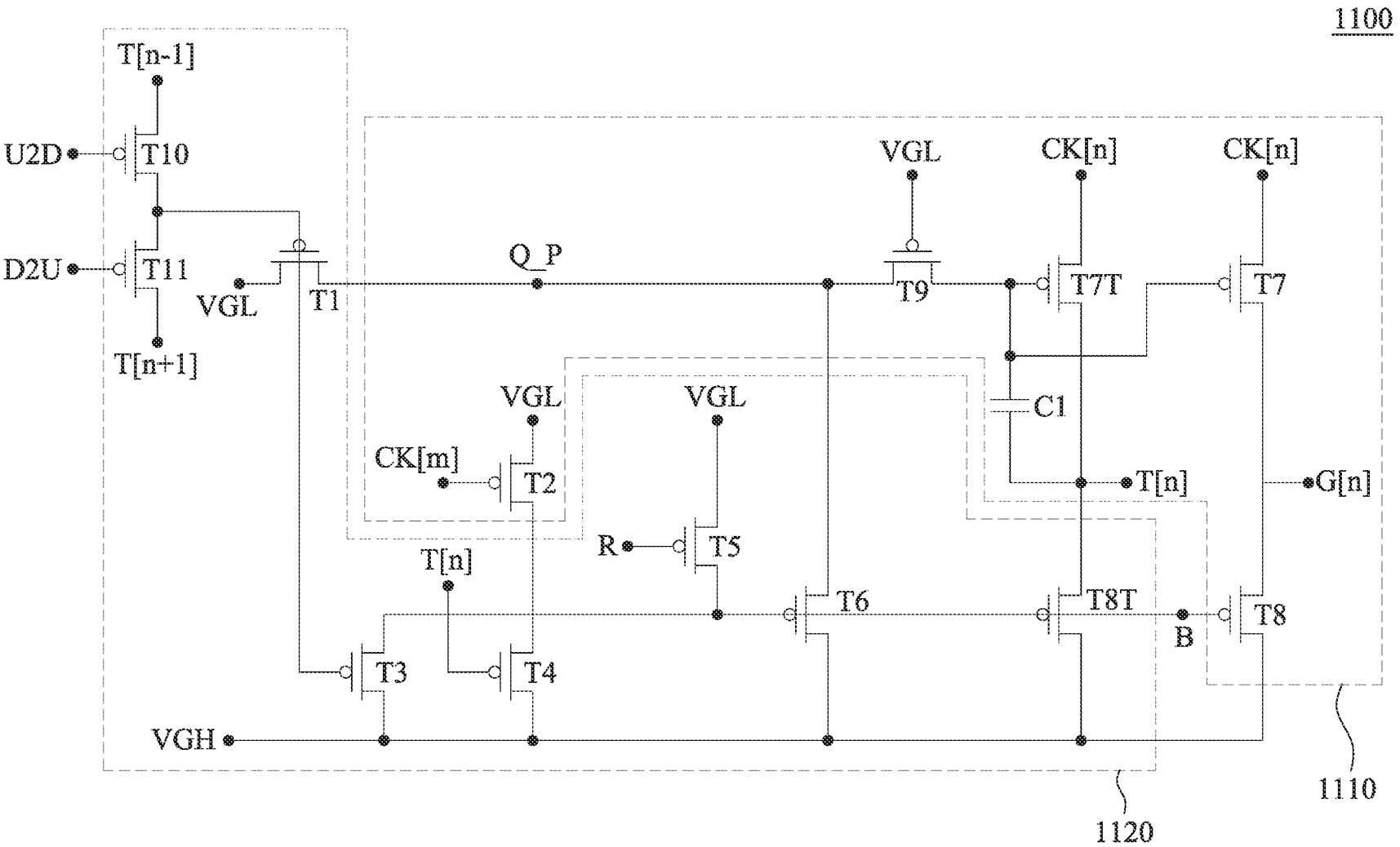
FIG. 2 depicts a schematic diagram of a driver integrated circuit according to some embodiments of the present disclosure.

FIG. 2 depicts a schematic diagram of a driver integrated circuit 1100 according to some embodiments of the present disclosure. In some embodiments, the diagram shown in FIG. 2 is corresponding to a layout shown in FIG. 1. In some embodiments, the driver integrated circuit 1100 includes a shift register.

Figure 3:
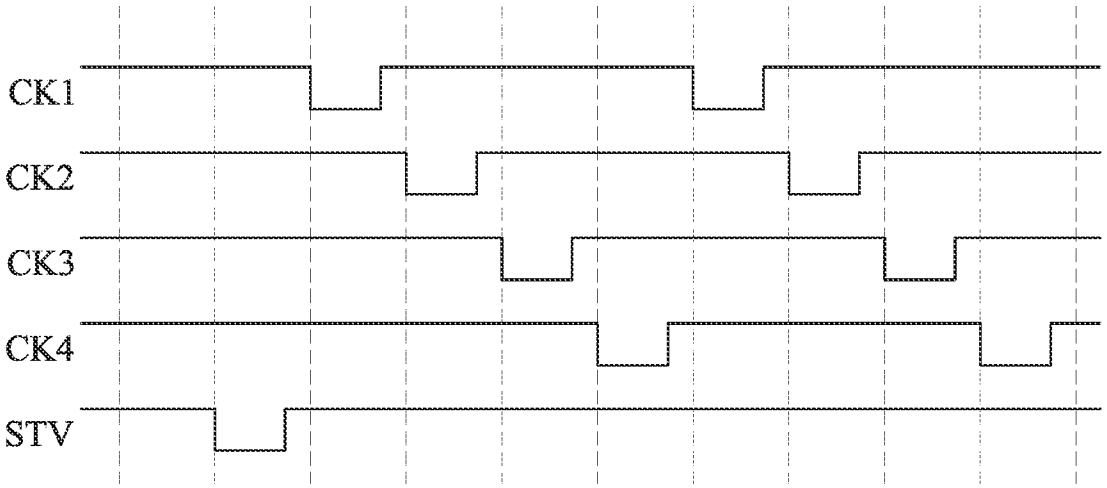
FIG. 3 depicts a timing diagram of driving signals of a driver integrated circuit according to some embodiments of the present disclosure.

In some embodiments, in order to facilitate the understanding of the driver integrated circuit 1100 FIG. 2, please refer to FIG. 3 together, FIG. 3 depicts a timing diagram of driving signals of a driver integrated circuit 1100 according to some embodiments of the present disclosure. The first circuit 1110 is configured to receive at least one first high-frequency signal (e.g. a high-frequency signal CK[m], and a high-frequency signal CK[n] shown in the figure). The second circuit 1120 is configured to receive at least one low-frequency signal (e.g. a voltage level VGL, a voltage level VGH, and an initial signal T[n]). The first circuit 1110 is configured to output at least one first driving signal G[n]. It is noted that the high-frequency signal includes an alternating current signal or a high-frequency signal, and the high-frequency signal can be designed according pixels per inch (PPI) of a panel. The low-frequency signal includes a fixed voltage level or a short initial signal. In addition, n in each of the high-frequency signal CK[n] and the initial signal T[n−1], T[n], and T[n+1] is a positive integer, and m in the high-frequency signal CK[m] is a positive integer. Moreover, each of the initial signal T[n−1], T[n], and T[n+1] is similar to the initial signal STV shown in FIG. 3.

Furthermore, please refer to FIG. 3, the high-frequency signals CK1 to CK4 are arranged from a top of FIG. 3 to a bottom of FIG. 3 according to the time sequence of high-frequency signals CK1 to CK4. As shown in FIG. 2 and FIG. 3, when a transistor T7 and a transistor T7T of the first circuit 1110 are configured to receive the high-frequency signal CK1, a transistor T2 of the first circuit 1110 are configured to receive the high-frequency signal CK3. In addition, when the transistor T7 and the transistor T7T of the first circuit 1110 are configured to receive the high-frequency signal CK2, the transistor T2 of the first circuit 1110 are configured to receive the high-frequency signal CK4. Moreover, when the transistor T7 and the transistor T7T of the first circuit 1110 are configured to receive the high-frequency signal CK3, the transistor T2 of the first circuit 1110 are configured to receive the high-frequency signal CK1. Furthermore, when the transistor T7 and the transistor T7T of the first circuit 1110 are configured to receive the high-frequency signal CK4, the transistor T2 of the first circuit 1110 are configured to receive the high-frequency signal CK2.

It should be noted that the transistor T7, the transistor T7T, and the transistor T2 are configured to receive the high-frequency signals CK1 to CK4 so as to isolate the high-frequency signals on the same side of data lines. Therefore, the transistor T7, the transistor T7T, and the transistor T2 must be disposed on the same side of traces which transmit high-frequency signals. Features of this circuit design are that a line which transmits high-frequency signals is paired with a transistor so that a line which transmits high-frequency signals and data lines do not interfere with each other.

Figure 4:
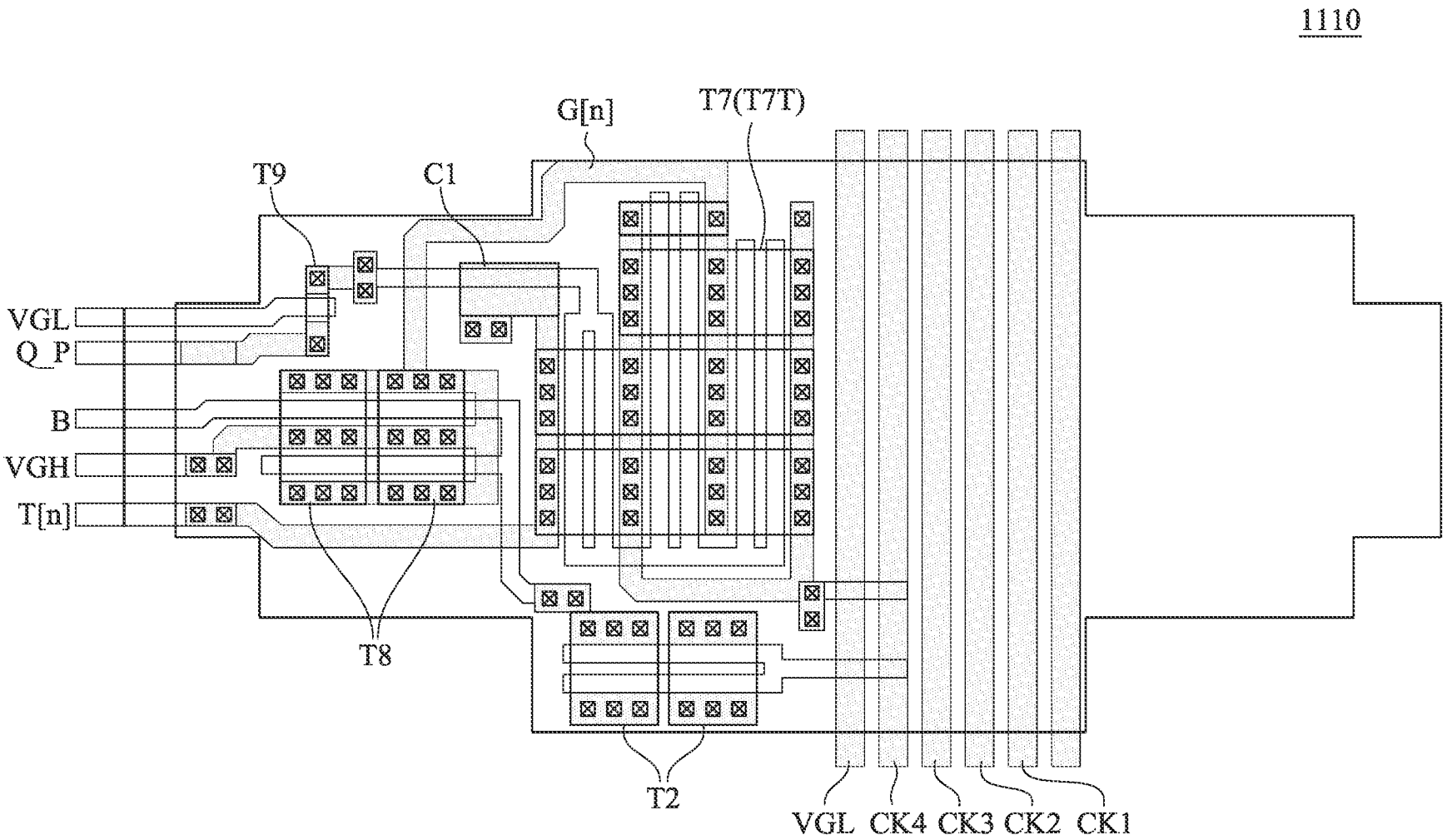
FIG. 4 depicts a enlarge view of part of layout of a pixel driving device according to some embodiments of the present disclosure.

FIG. 4 depicts a enlarge view of part of a layout of a pixel driving device 1000 shown in FIG. 1 according to some embodiments of the present disclosure. In some embodiments, the first circuit 1110 shown in FIG. 4 is corresponding to the embodiments shown in FIG. 1 and FIG. 2. In some embodiments, the first circuit 1110 is disposed on the same side with traces which transmit high-frequency signals CK1 to CK4. The first circuit 1110 is coupled to the second circuit 1120 shown in FIG. 1 to transmit low-frequency signals (e.g. the voltage level VGL, the voltage level VGH, and the initial signal T[n]) so as to output a driving signal G[n].

Figure 5:
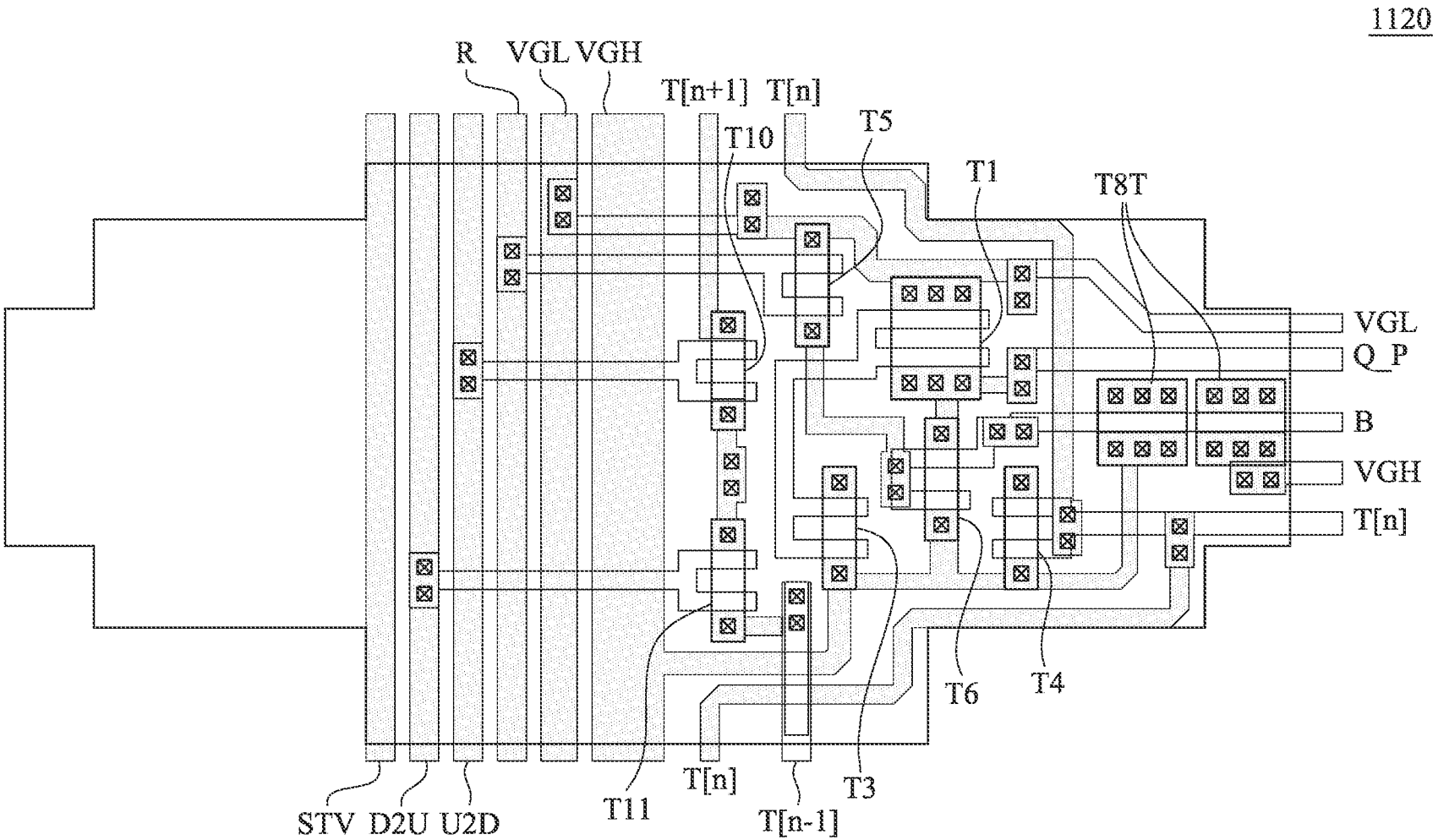
FIG. 5 depicts a enlarge view of part of layout of a pixel driving device according to some embodiments of the present disclosure.

FIG. 5 depicts a enlarge view of part of layout of a pixel driving device 1000 shown in FIG. 1 according to some embodiments of the present disclosure. In some embodiments, the second circuit 1120 shown in FIG. 5 is corresponding to the embodiments shown in FIG. 1 and FIG. 2. The second circuit 1120 is disposed on the same side with traces which transmit low-frequency signals (e.g. the voltage level VGL, the voltage level VGH, and the initial signal T[n]). The second circuit 1120 is coupled to a node Q_P and a node B so as to transmit the low-frequency signals to the first circuit 1110 shown in FIG. 4.

Figure 6:
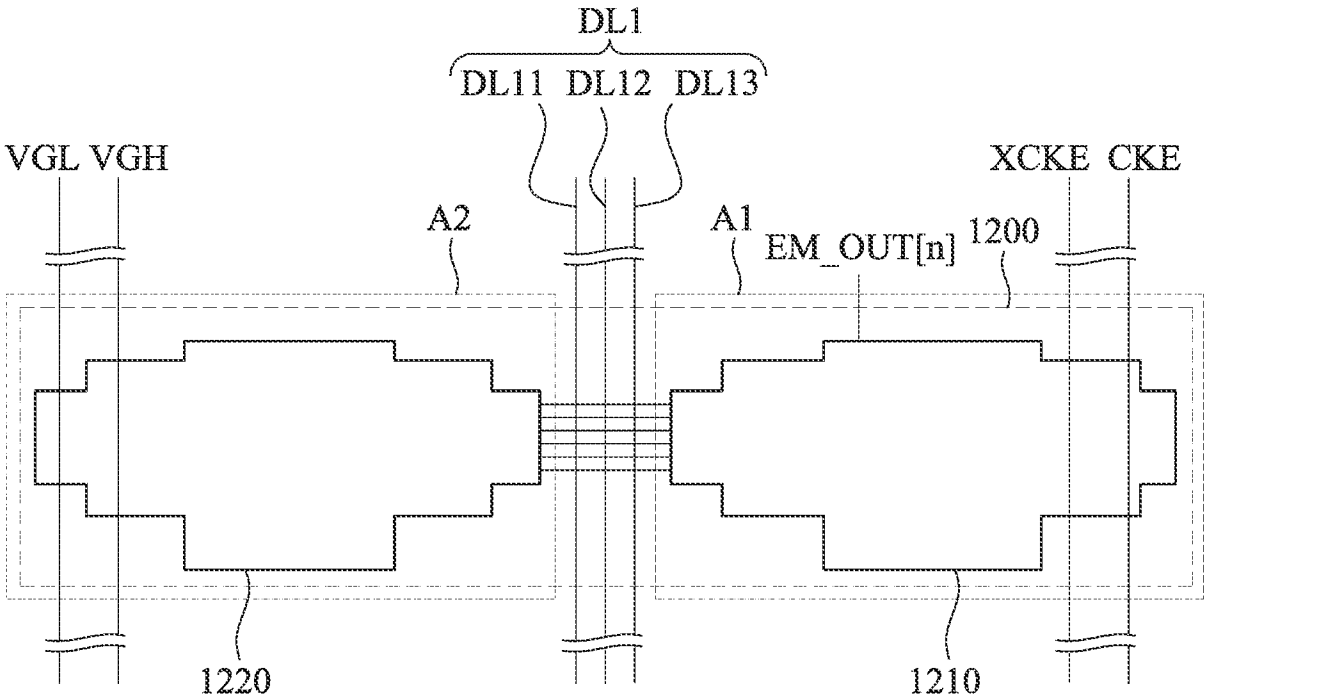
FIG. 6 depicts a schematic diagram of a pixel driving device according to some embodiments of the present disclosure.

FIG. 6 depicts a schematic diagram of a pixel driving device 1000 according to some embodiments of the present disclosure. In some embodiments, the driver integrated circuit 1200 includes a pixel driving circuit. Compared with the driver integrated circuit 1100 shown in FIG. 1, embodiments shown in FIG. 6 only replace the driver integrated circuit 1100 with different structures and functions of the driver integrated circuit 1200 shown in FIG. 6. The at least one driver integrated circuit 1200 includes a first circuit 1210 and a second circuit 1220. The first circuit 1210 is disposed in the first area A1, and is configured to receive at least one first high-frequency signal CKE and XCKE. The second circuit 1220 is disposed in the second area A2 and is coupled to the first circuit 1210, is configured to receive the at least one low-frequency signal VGH and VGL. The first circuit 1210 is configured to output at least one first driving signal EM_OUT[n].

Figure 7:
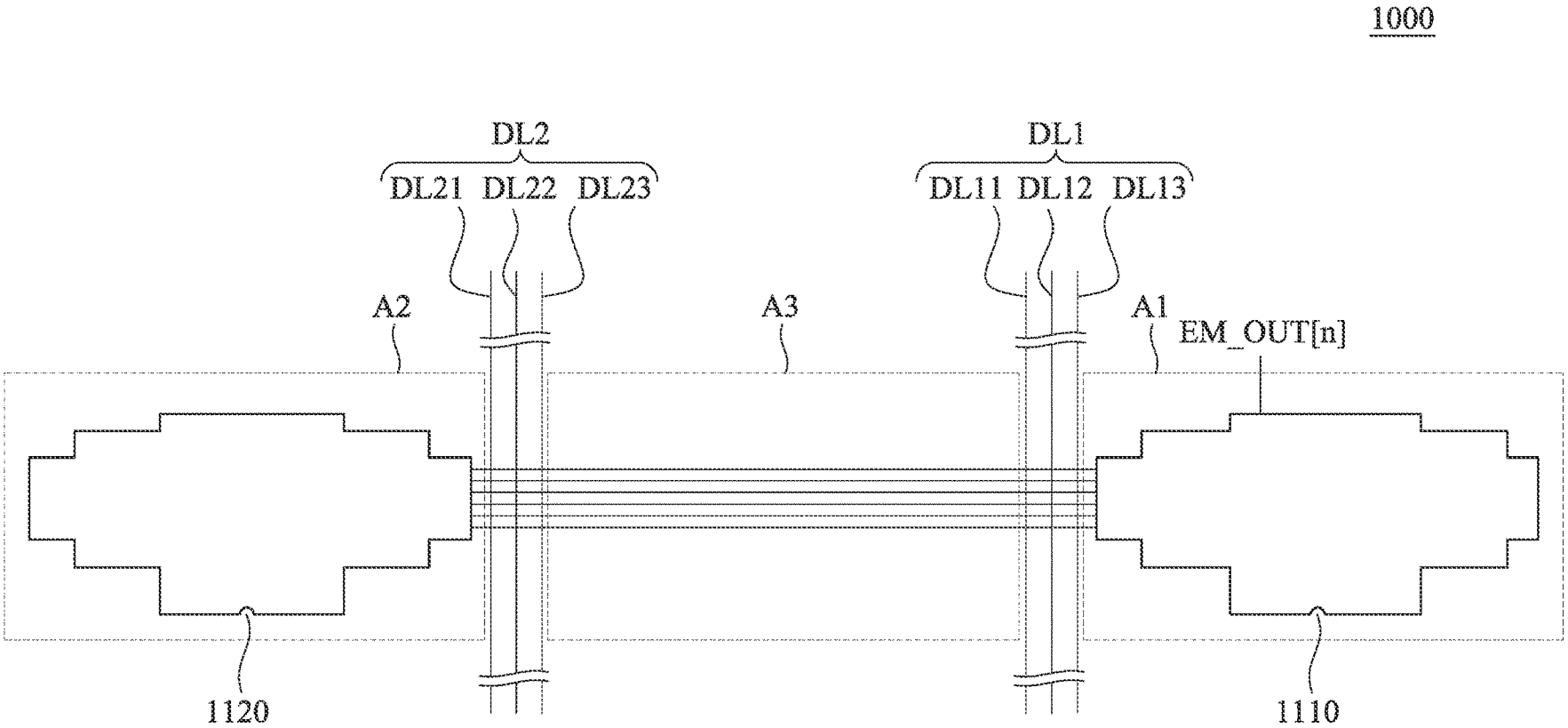
FIG. 7 depicts a schematic diagram of a pixel driving device according to some embodiments of the present disclosure.

FIG. 7 depicts a schematic diagram of a pixel driving device 1000 according to some embodiments of the present disclosure. Based on a design architecture that a line which transmits high-frequency signals is paired with a transistor, the first circuit 1110 and the second circuit 1120 can be separated by a plurality of data lines. A distance between the first circuit 1110 and the second circuit can be adjusted according to actual needs. The at least one data line includes a plurality of first data lines DL1 and a plurality of second data lines DL2. The plurality of first data lines DL1 (e.g. a data line DL11, a data line DL12, and a data line DL13) are adjacent to each other. The plurality of second data lines DL2 (e.g. a data line DL21, a data line DL22, and a data line DL23) are adjacent to each other.

It should be noted that the plurality of first data lines DL1 and the plurality of second data lines DL2 represent different rows of data lines or different columns of data lines respectively. Therefore, the plurality of first data lines DL1 and the plurality of second data lines DL2 separate three areas in the pixel driving device 1000. In other words, the plurality of first data lines DL1 and the plurality of second data lines DL2 are located between the first area A1, the second area A2, and third area A3 respectively. The first circuit 1110 is disposed in the first area A1 and the second circuit 1120 is disposed in the second area A2. The third area A3, the plurality of first data lines DL1, and the plurality of second data lines DL2 are located between the first area A1 and the second area A2, and are not limited to embodiments shown in the figure. In some embodiments, the aforementioned first circuit 1110 can be replaced with the first circuit 1210 shown in FIG. 6. The aforementioned second circuit 1120 can be replaced with the second circuit 1220 shown in FIG. 6. The first area A1, the second area A2, and the third area A3 are not overlapped with each other.

Figure 8:
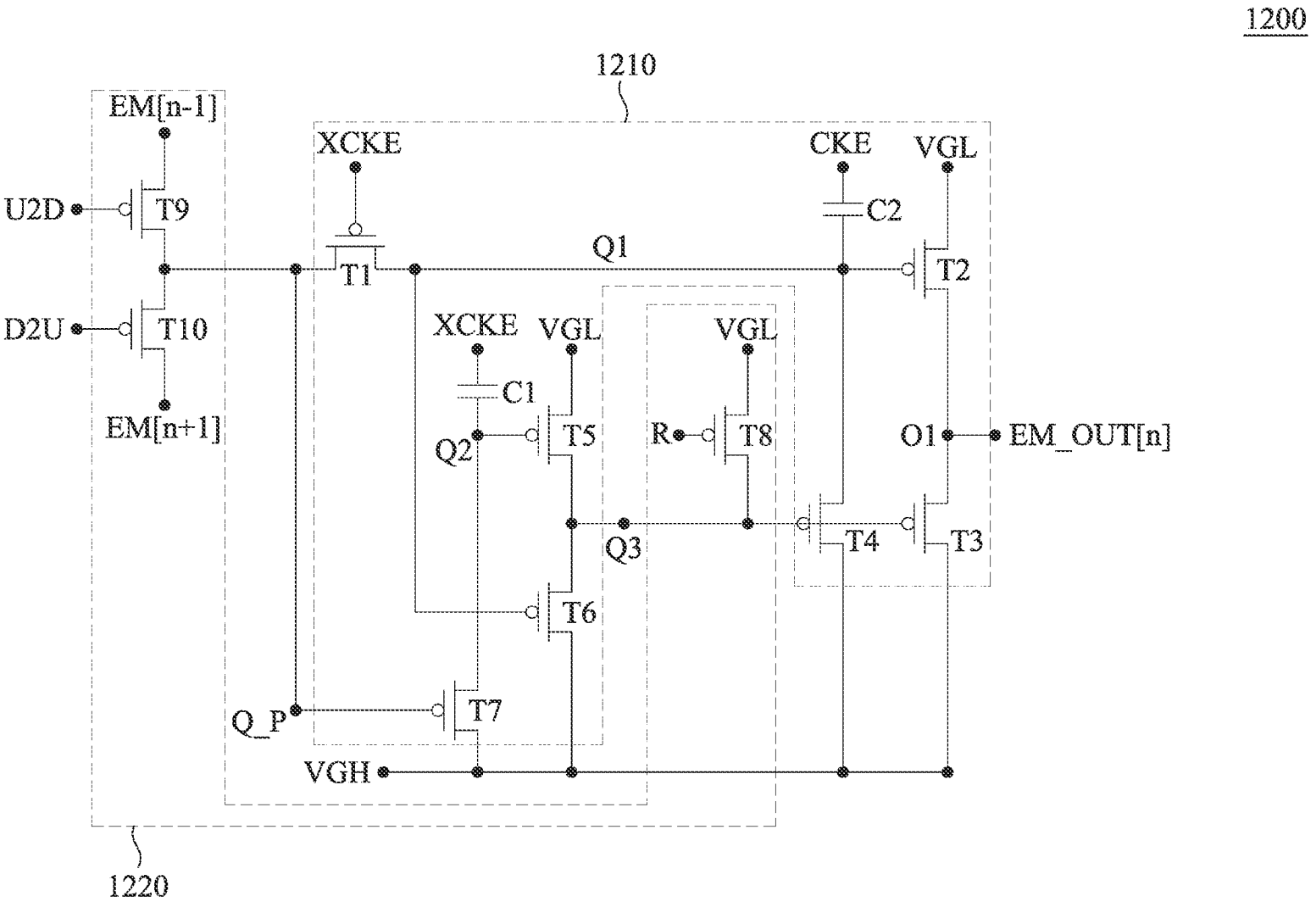
FIG. 8 depicts a schematic diagram of a driver integrated circuit according to some embodiments of the present disclosure.

FIG. 8 depicts a schematic diagram of a driver integrated circuit 1200 according to some embodiments of the present disclosure. In some embodiments, as shown in FIG. 8, the schematic diagram of FIG. 8 is corresponding to the schematic diagram of FIG. 6. The first circuit 1210 is configured to receive at least one first high-frequency signal (e.g. a high-frequency signal CKE, and a high-frequency signal XCKE shown in the figure). The second circuit 1220 is configured to receive at least one low-frequency signal (e.g. the voltage level VGL, the voltage level VGH, and an initial signal EM[n]). The first circuit 1210 is configured to output at least one first driving signal EM_OUT[n]. It is noted that a phase shift is between the high-frequency signal CKE and the high-frequency signal XCKE. In addition, n in the initial signals EM[n−1], EM [n], EM [n+1], and the first driving signal EM_OUT[n] is a positive integer.

Figure 9:
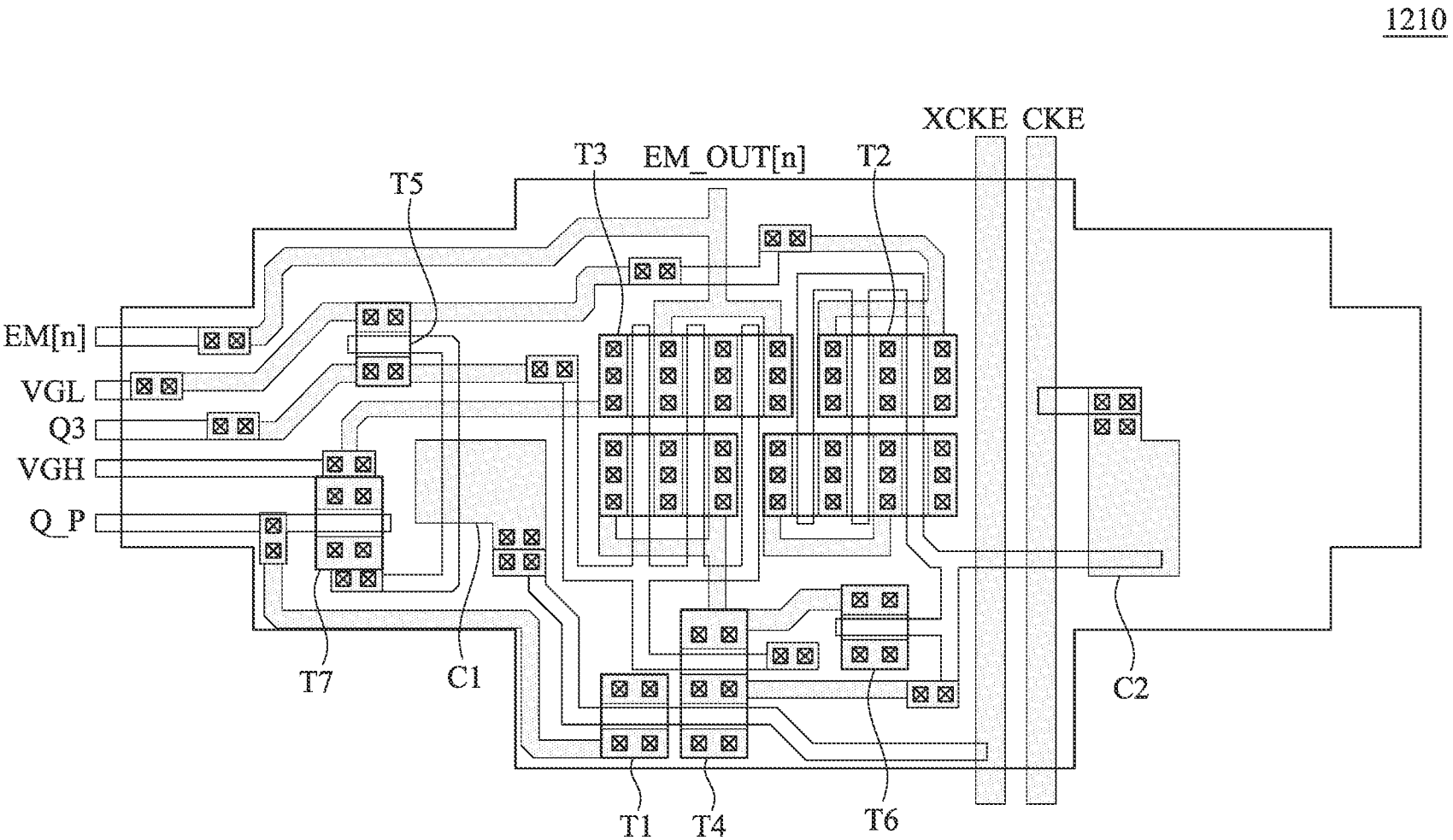
FIG. 9 depicts a enlarge view of part of a layout of a pixel driving device according to some embodiments of the present disclosure.

FIG. 9 depicts a enlarge view of part of a layout of a pixel driving device 1000 shown in FIG. 6 according to some embodiments of the present disclosure. In some embodiments, the first circuit 1210 shown in FIG. 9 is corresponding to embodiments shown in FIG. 6 and FIG. 8. The first circuit 1210 and the second circuit 1220 are coupled to each other to transmit low-frequency signals (e.g. the voltage level VGL, the voltage level VGH, and the initial signal EM[n]) so as to output the first driving signal EM_OUT[n]. The first circuit 1210 and traces which transmit high-frequency signal CKE and XCKE are disposed on the same side. It is noted that when an alternating current signal passes through a capacitor, a frequency of an alternating current signal is higher so that the alternating current signal is easier to pass through a capacitor. It means that a capacitor C1 and a capacitor C2 cannot isolate the high-frequency signals CKE and XCKE basically.

Therefore, the use of a transistor T1, a transistor T4, and a transistor T7 are as a switch to isolate the high-frequency signals CKE and XCKE.

In some embodiments, each of the transistor T1, the transistor T4, and the transistor T7 is configured to receive the high-frequency signals CKE and XCKE so as to isolate the high-frequency signals form the first area A1 of data lines. Therefore, each of the transistor T1, the transistor T4, and the transistor T7 must be disposed on the same side with traces which transmit high-frequency signals. In some embodiments, a transistor T2, a transistor T5, a transistor T6, the capacitor C1, and the capacitor C2 must also be disposed on the same side with traces which transmit high-frequency signals.

Figure 10:
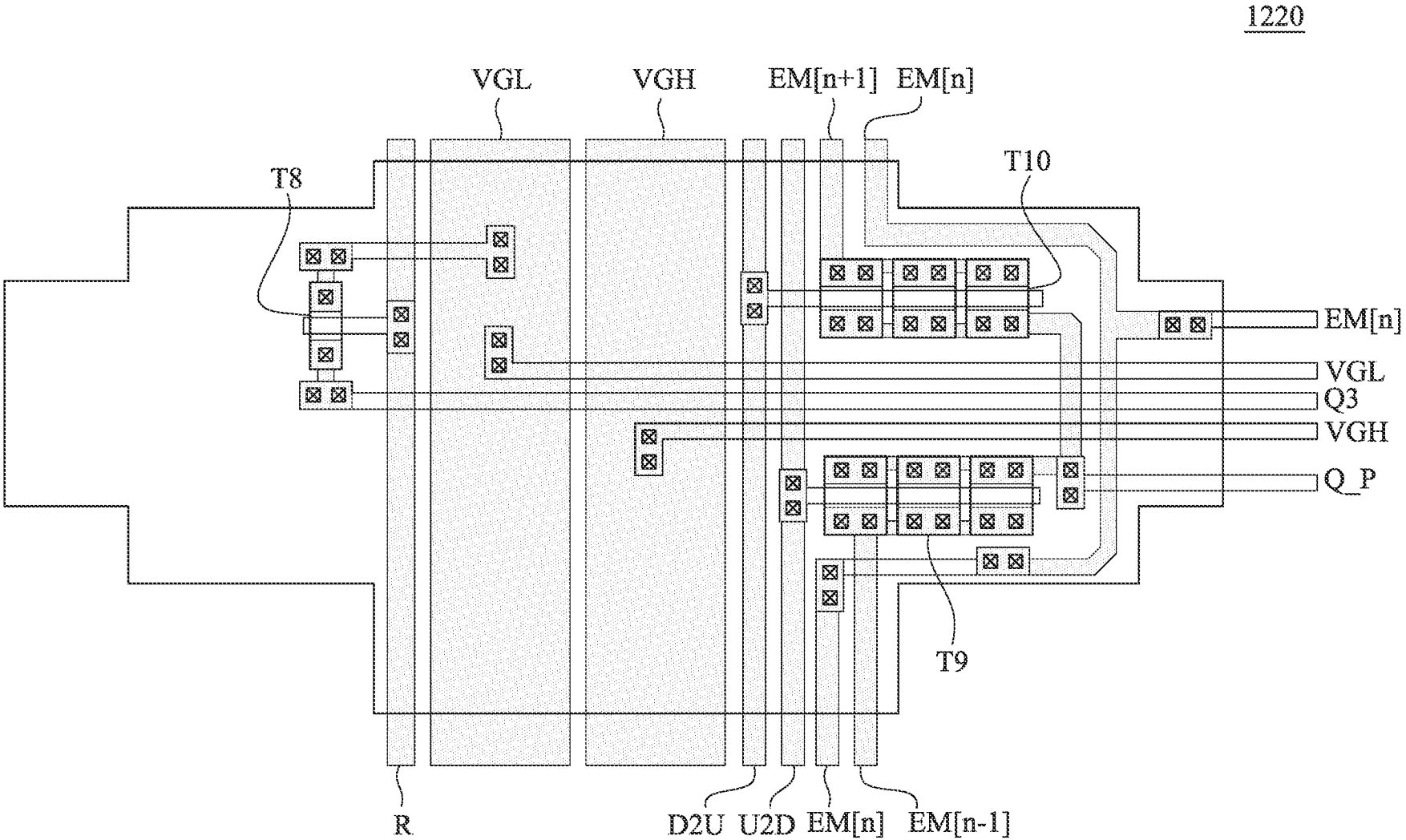
FIG. 10 depicts a enlarge view of part of a layout of a pixel driving device according to some embodiments of the present disclosure.

FIG. 10 depicts a enlarge view of part of a layout of a pixel driving device 1000 shown in FIG. 6 according to some embodiments of the present disclosure. In some embodiments, the second circuit 1220 shown in FIG. 10 is corresponding to embodiments shown in FIG. 6 and FIG. 8. The second circuit 1220 and traces which transmit low-frequency signals (e.g. the voltage level VGL, the voltage level VGH, and the initial signal EM[n]) are disposed on the same side. The second circuit 1220 is coupled to a node Q_P and a node Q3 so as to transmit low-frequency signals to the first circuit 1210.

Figure 11:
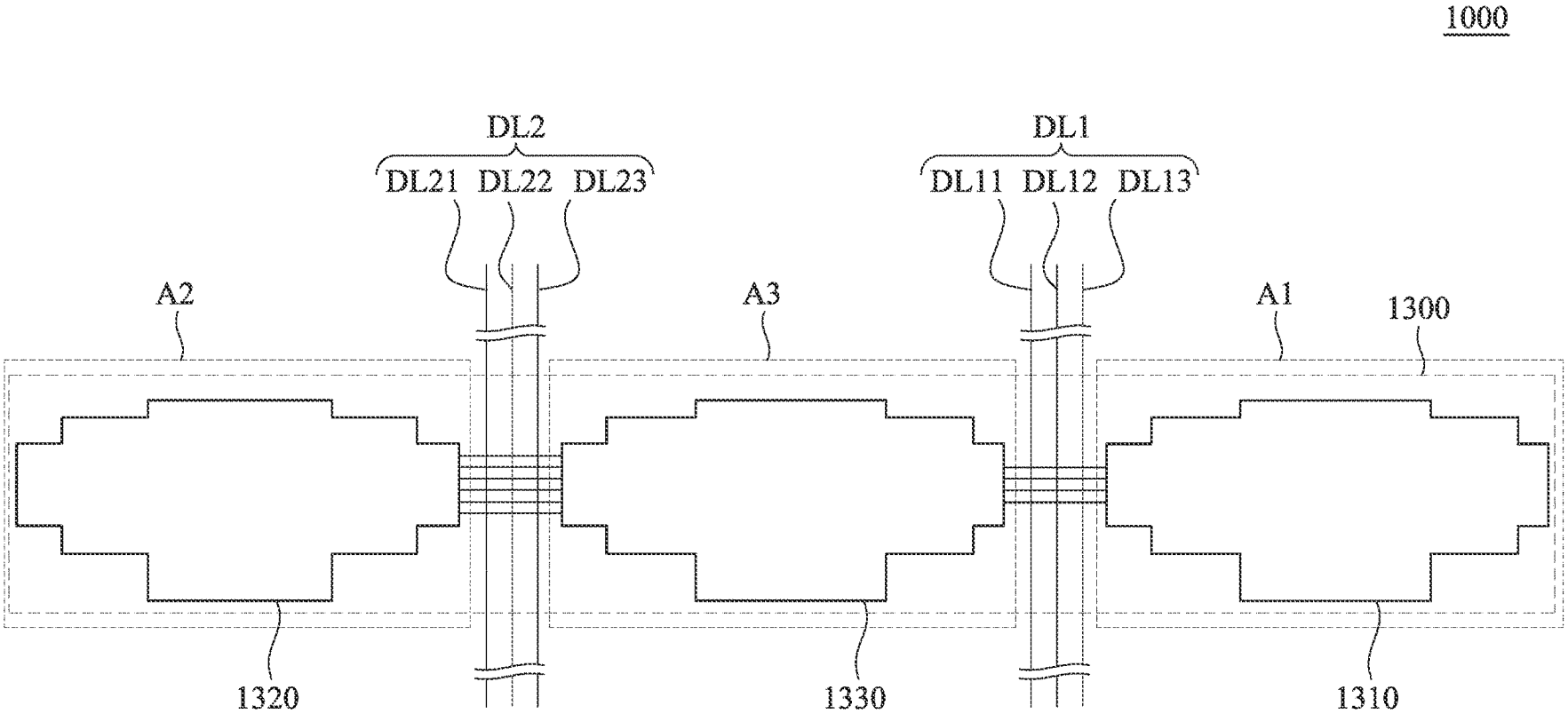
FIG. 11 depicts a schematic diagram of a pixel driving device according to some embodiments of the present disclosure.

FIG. 11 depicts a schematic diagram of a pixel driving device 1000 according to some embodiments of the present disclosure. In some embodiments, the pixel driving device 1000 further includes a third area A3. The plurality of first data lines DL1 and the plurality of second data lines DL2 are located between the first area A1, the second area A2, and the third area A3 respectively. The at least one driver integrated circuit 1300 includes a first circuit 1310 and a second circuit 1320. The at least one driver integrated circuit 1300 further includes a third circuit 1330. The third circuit 1330 is coupled to the second circuit 1320. The first circuit 1310, the second circuit 1320, and the third circuit 1330 are disposed in the first area A1, the second area A2, and the third area A3 respectively.

In some embodiments, the pixel driving device 1000 includes a first side (a right side shown in the figure) and a second side (a left side shown in the figure). It is noted that although the first side and the second side are depicted as the left side and the right side in the figure respectively. In practice, the first side and the second side are not limited to the left side and the right side. In some embodiments, an arrange sequence from the first side of the pixel driving device 1000 to the second side of the pixel driving device 1000 is the first area A1, the plurality of first data lines DL1 (data line DL11, data line DL12, and data line DL13), the third area A3, the plurality of second data lines DL2 (data line DL21, data line DL22, and data line DL23), and the second area A2. It is noted that locations of areas and locations of circuits of the present disclosure are not limited to the embodiment shown in the figure.

In some embodiments, the first area A1, the second area A2, and the third area A3 are arranged on the same straight line.

Figure 12:
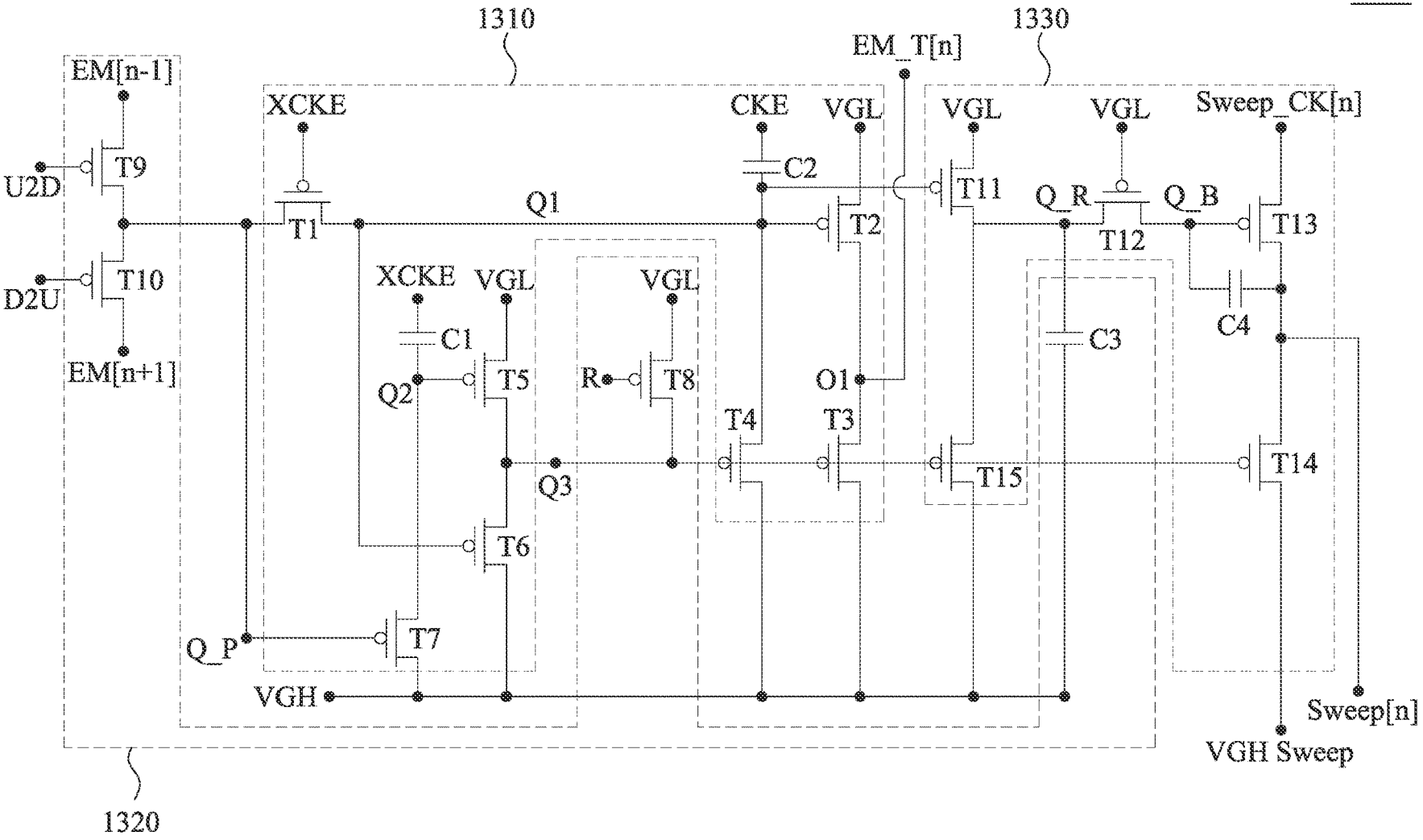
FIG. 12 depicts a schematic diagram of a driver integrated circuit according to some embodiments of the present disclosure.

FIG. 12 depicts a schematic diagram of a driver integrated circuit 1300 according to some embodiments of the present disclosure. In some embodiments, compared with embodiments shown in FIG. 8, the driver integrated circuit 1300 shown in FIG. 12 only adds a third circuit 1330, a transistor T11, a transistor T15, and a capacitor C3. The third circuit 1330 is configured to receive at least one second high-frequency signal Sweep_CK[n] so as to output at least one second driving signal Sweep[n], and n in the second driving signal Sweep[n] is a positive integer.

In some embodiments, a waveform of at least one first high-frequency signal CKE and XCKE received by the first circuit 1310 is different from or equal to a waveform of the at least one second high-frequency signal Sweep_CK[n] received by the third circuit 1330. In some embodiments, a waveform of first driving signal EM_T[n] from the first circuit 1310 is different from or equal to a waveform of at least one second driving signal Sweep[n] from the third circuit 1330 and n in the second high-frequency signal Sweep_CK[n] and second driving signal Sweep[n] is a positive integer.

Figure 13:
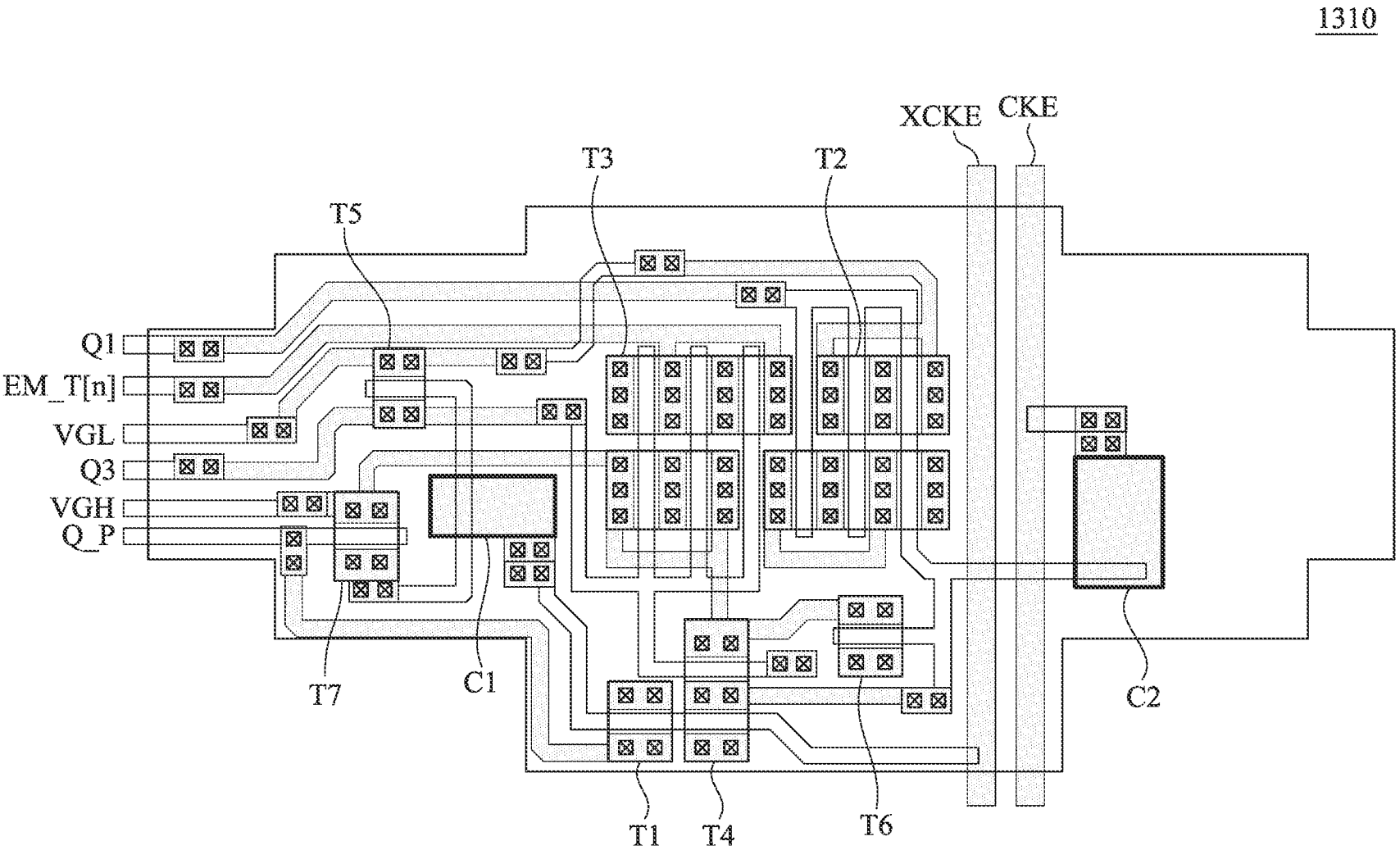
FIG. 13 depicts a enlarge view of part of a layout of a pixel driving device according to some embodiments of the present disclosure.

FIG. 13 depicts a enlarge view of part of a layout of a pixel driving device 1300 shown in FIG. 12 according to some embodiments of the present disclosure. In some embodiments, compared with embodiment shown in FIG. 9, a difference between FIG. 9 and FIG. 13 is that a location of an output end which outputs the driving signal EM_T[n] is moved from the first circuit 1310 to the second circuit 1320. It is noted that the driving signal EM__OUT[n] shown in FIG. 9 is the same with the driving signal EM_T[n] shown in FIG. 13, and n in the driving signal EM_T[n] is a positive integer.

Figure 14:
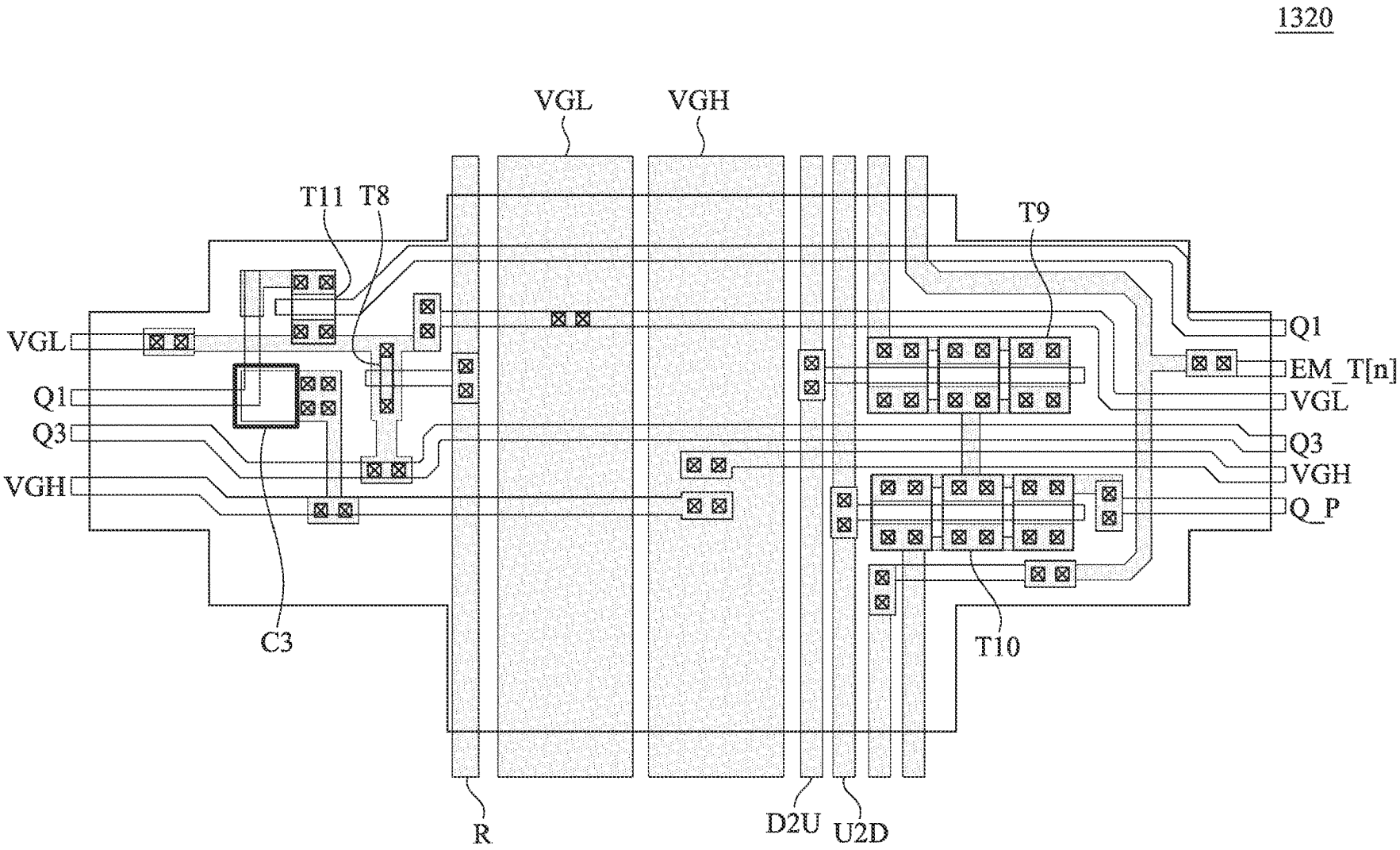
FIG. 14 depicts a enlarge view of part of a layout of a pixel driving device according to some embodiments of the present disclosure.

FIG. 14 depicts a enlarge view of part of a layout of a pixel driving device 1300 shown in FIG. 12 according to some embodiments of the present disclosure. In some embodiments, compared with embodiment shown in FIG. 10, a right side of the second circuit 1320 shown in FIG. 14 is coupled to the first circuit 1310, and a left side of the second circuit 1320 is coupled to the third circuit 1330. The second circuit 1320 is configured to transmit low-frequency signals (e.g. the voltage level or low-frequency signals VGL and VGH) to the first circuit 1310 and the third circuit 1330 respectively.

Figure 15:
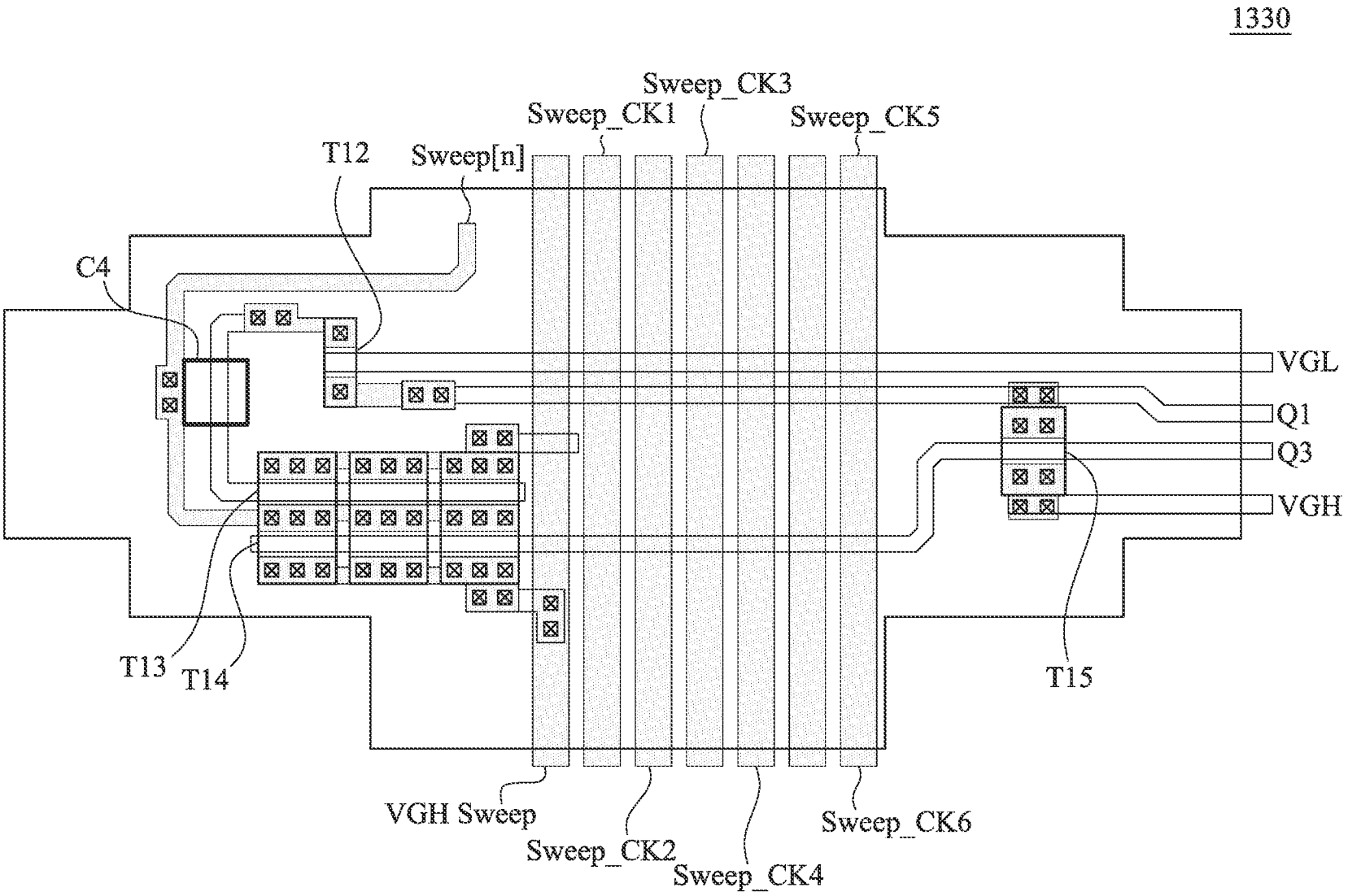
FIG. 15 depicts a enlarge view of part of a layout of a pixel driving device according to some embodiments of the present disclosure.

FIG. 15 depicts a enlarge view of part of a layout of a pixel driving device 1300 shown in FIG. 12 according to some embodiments of the present disclosure. In some embodiments, as shown in FIG. 15, the third circuit 1330 and traces which transmit the second high-frequency signal Sweep_CK[n] are disposed on the same side. The third circuit 1330 is configured to receive the second high-frequency signal Sweep_CK[n] and the low-frequency signals from the second circuit 1320 so as to the second driving signal Sweep[n]. When the third circuit 1330 receive the second high-frequency signal Sweep_CK1, the third circuit 1330 outputs a second driving signal Sweep[n]. Sweep signal generating steps that the third circuit 1330 using second high-frequency signals Sweep_CK2, Sweep_CK3, Sweep_CK4, Sweep_CK5, and Sweep_CK6 to generate a sweep signal are similar to a sweep signal generating step that the third circuit 1330 using second high-frequency signal Sweep_CK1 to generate a sweep signal, and repetitious details are omitted herein.

In some embodiments, each of the aforementioned first circuit 1110 to 1310, the aforementioned second circuit 1120 to 1320, and the aforementioned third circuit 1330 is not a pixel circuit. In some embodiments, the pixel driving device 1000 includes the aforementioned driver integrated circuit 1100, the aforementioned driver integrated circuit 1200, and the aforementioned driver integrated circuit 1300.

Based on the above embodiments, the present disclosure provides a pixel driving device with that a line which transmits high-frequency signals is paired with a transistor so as to improve a display mura in a panel.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the present disclosure. In view of the foregoing, it is intended that the present disclosure cover modifications and variations of the present disclosure provided they fall within the scope of the following claims.

What is claimed is:

1. A pixel driving device, comprising:

at least one data line, wherein the at least one data line comprises a first area and a second area which are located on both sides of the at least one data line, wherein the first area and the second area are separated by the at least one data line; and at least one driver integrated circuit, comprising:

a first circuit, disposed in the first area, and configured to receive at least one first high-frequency signal so as to output at least one first driving signal; and a second circuit, disposed in the second area, coupled to the first circuit, and configured to receive at least one low-frequency signal.

2. The pixel driving device of claim 1, wherein the at least one data line comprises a plurality of first data lines and a plurality of second data lines, wherein the first data lines are adjacent to each other, wherein the second data lines are adjacent to each other and are parallel to the first data lines, wherein the pixel driving device further comprises a third area, wherein the first data lines and the second data lines are located between the first area, the second area, and the third area respectively.

3. The pixel driving device of claim 2, wherein the third area, the first data lines, and the second data lines are located between the first area and the second area.

4. The pixel driving device of claim 3, wherein the at least one driver integrated circuit further comprises:

a third circuit, coupled to the second circuit, and configured to receive at least one second high-frequency signal so as to output at least one second driving signal, wherein a waveform of the at least one first high-frequency signal is different form or a same with a waveform of the at least one second high-frequency signal, wherein a waveform of the at least one first driving signal is different form or a same with a waveform of the at least one second driving signal.

5. The pixel driving device of claim 4, wherein the first circuit, the second circuit, and the third circuit are disposed in the first area, the second area, and the third area respectively.

6. The pixel driving device of claim 5, wherein the pixel driving device comprises a first side and a second side, wherein an arrange sequence from the first side of the pixel driving device to the second side of the pixel driving device is the first area, the first data lines, the third area, the second data lines, and the second area.

7. The pixel driving device of claim 6, wherein the first area, the second area, and the third area are arranged on a same straight line.

8. The pixel driving device of claim 1, wherein the at least one first high-frequency signal comprises an alternating current signal, wherein the at least one low-frequency signal comprises one of a direct current level and a pulse signal.

9. A pixel driving device, comprising:

at least one driver integrated circuit, comprising:

a first circuit, configured to receive a high-frequency signal and output a driving signal, wherein the first circuit is disposed in a first area of the pixel driving device;

a second circuit, coupled to the first circuit, and configured to receive a low-frequency signal, wherein the second circuit is disposed in a second area of the pixel driving device; and a third circuit, coupled to the second circuit, and configured to receive the high-frequency signal, wherein the third circuit is disposed in a third area of the pixel driving device;

wherein the first area, the second area, and the third area are not overlapped with each other.

10. The pixel driving device of claim 9, wherein the pixel driving device comprises:

a plurality of first data lines, wherein the first data lines are adjacent to each other; and a plurality of second data lines, wherein the second data lines are adjacent to each other, wherein the first data lines and the second data lines are disposed in the first area, the second area, and the third area respectively.

* * * * *